United States Patent [19]

Plaks et al.

[11] Patent Number: 5,059,219

[45] Date of Patent: Oct. 22, 1991

[54] ELECTROPRECIPITATOR WITH ALTERNATING CHARGING AND SHORT COLLECTOR SECTIONS

[75] Inventors: Norman Plaks, Raleigh; Leslie E. Sparks, Durham, both of N.C.

[73] Assignee: The United States Goverment as represented by the Administrator of the Environmental Protection Agency, Washington, D.C.

[21] Appl. No.: 588,224

[22] Filed: Sep. 26, 1990

[51] Int. Cl.[5] ..... B03C 3/00

[52] U.S. Cl. ..... 55/138; 55/151

[58] Field of Search ..... 55/136–138, 55/151

[56] References Cited

U.S. PATENT DOCUMENTS

| | | | |
|---|---|---|---|
| 1,357,466 | 11/1920 | Moller | 55/138 |
| 3,026,964 | 3/1962 | Penney | 183/7 |
| 3,668,836 | 6/1972 | Richardson et al. | 55/131 |
| 3,907,520 | 9/1975 | Huang et al. | 55/4 |
| 3,951,624 | 4/1976 | Snader et al. | 55/128 |
| 3,994,704 | 11/1976 | Shibuya et al. | 55/130 |
| 4,126,434 | 11/1978 | Keiichi et al. | 55/137 |
| 4,259,707 | 3/1981 | Penney | 55/138 |
| 4,264,343 | 4/1981 | Natarajan et al. | 55/126 |

*Primary Examiner*—Bernard Nozick

[57] ABSTRACT

The novel ESP has a plurality of collector sections alternating in series with a plurality of prechargers (charging sections) with each collector section being preceded by a charging section. Each collector section contains a plurality of collection plates spaced by a distance d to define a plurality of gas flow lanes therebetween. Each gas flow lane contains 1–4 corona discharge wires aligned parallel to the gas flow. Each charging section contains a plurality of corona discharge electrodes alternating with anodes in an array transverse to the gas flow. Each collector section is much shorter than in the prior art, both in actual length and in relation to the length of the length of the charging section and the interplate spacing d.

12 Claims, 4 Drawing Sheets

ELECTROPRECIPITATOR WITH ALTERNATING CHARGING AND SHORT COLLECTOR SECTIONS

FIELD OF THE INVENTION

This invention relates to electrostatic precipitators (hereinafter "ESPs") and, more specifically, to apparatus and method of reducing particulate emissions, i.e. penetration, to a lower level than heretofore possible with an ESP of comparable size.

PRIOR ART

Control of particulate emissions from industrial sources is presently accomplished largely by fabric filters and ESPs. The greatest volume of gas cleanup is accomplished by precipitators. Conventional ESP technology operates upon the principle that charging and collection of the charged particles takes place in the same section of the precipitator. To accomplish this simultaneous charging and collection, a multiplicity of corona discharge electrodes are placed along the center line between a pair of grounded collecting plates. A sufficiently high voltage is placed upon the corona discharge electrodes to cause the generation of a visible corona. The copious supply of ions formed by the corona charges the particles, which are then attracted to the collecting plates by the electric field caused by the high voltage placed on the corona discharge electrodes in respect to ground. Conventional ESPs are well documented by an abundant number of textbooks and other literature. Examples in the literature are: H. White, *Industrial Electrostatic Precipitation*, Addison-Wesley, Reading, MA, 1963; and S. Oglesby and G. Nichols, *Electrostatic Precipitation*, Marcel-Dekker, NY, 1978. An improvement in such conventional ESP technology is disclosed in our U.S. Pat. No. 4,822,381 entitled "Electroprecipitator with Suppression of Rapping Reentrainment."

The conventional ESP art, as currently practiced, teaches, both explicitly and implicitly, that for maximum collection of particles, individual ESP sections should be as physically long as is possible. At the same time the art teaches that the ESP should be divided into as many of these physically long sections as possible, each of which is individually energized.

To improve operation of ESPs, especially with high resistivity particulate matter, the two-stage precipitator has been developed. The two-stage precipitator operates by placing a precharger at the gas inlet of the ESP to charge the particles prior to their collection. This arrangement allows both the charging and collection steps to be optimized. However, again, improvements in efficiency have been sought primarily by lengthening the collector section.

SUMMARY OF THE INVENTION

Accordingly, it is an object of the present invention to provide a electroprecipitator (ESP) which is more efficient per unit length than the conventional ESP.

The collection efficiency, $E_{ff}$, of an ESP is expressed by the Deutsch-Anderson equation:

$$E_{ff} = 1 - \exp\left(-\frac{A}{q} w\right)$$

in which A is the area of the collecting electrode, q is the volumetric flow rate of the gas, and w is the migration velocity of the charged particle under the influence of the electric field. It is obvious that for a given gas flow rate that the ESP collection efficiency is a function of the collecting electrode area and the migration velocity. As A and w increase in size the exponential term on the right gets smaller, and the efficiency increases. The migration velocity, w, is a function of the electrical charge upon the particle and the strength of the electric field; it increases with both.

In this invention it was discovered that by the use of a multiplicity of very short collecting electrode sections each of which is preceded by a particle charging section, it is possible to make the migration velocity, w, very high. This allows the collecting electrode area to be made very much smaller, thereby allowing a very significant overall reduction in size for the ESP. Each combination of charging section followed by a physically short collecting section will be subsequently called a module.

The present invention, in providing a multiplicity of modules, each of which consists of a short collecting section each preceded by a charging section to make a physically small high efficiency ESP, is contrary to and flies in the face of the teaching of workers in the field of ESPs, and the years of evolutionary development of the art. Current teaching is to use two or more collecting sections that are as long as 3.6 m or more in the direction of gas flow.

The desirability of using short collector sections rather than longer ones is illustrated by FIG. 6. This figure relates the particle penetration for a single module as a function of the number of electrodes in the collector section. The particle penetration, which is the uncollected fraction of the entering particles, decreases rapidly as the number of electrodes increases. With two to three electrodes the decrease in penetration begins leveling off. Further increases in the number of electrodes provides little improvement. The penetration is somewhat better for low resistivity (about $1\times10^{10}$ ohm-cm) particulate matter than for high resistivity ($1\times10^{12}$ ohm-cm) material. The lower resistivity particulate matter allows a higher corona current in the collector section which provides some increased particle charging there and a consequent decrease in penetration.

There is relationship between the number of electrodes and the module length. As the number of electrodes increases so does the length of the collector section, and consequently so does the length of the module. Two modules in series, each of which provides a penetration that is a small fraction of the incoming particles, will provide an overall penetration that is less than the penetration of a longer module. For example, two modules each having a penetration of 0.2 will have a penetration of about 0.04, which could not be achieved by a single module of reasonable length. Increasing the number of small modules, to more than two, will provide even further reductions in penetration.

It was further discovered that a module containing a charger and a short collection section will provide about the same amount of particulate matter collection as will a long section in a conventional ESP. Consequently an improved ESP made up of a multiplicity of modules, each of which consists of a charging section followed by a short collector section, will provide the same performance as would a conventional ESP made up of a multiplicity of long sections in which the particulate matter is simultaneously charged and collected.

Consequently, the improved ESP will be physically smaller than would be a conventional ESP, both in overall length and in collection plate area. The smaller physical size will result in a significant cost savings.

To attain a very high value for the migration velocity it is necessary to place a very high level of charge upon the particles, and to collect them in a very high electric field. This is accomplished by placing a charging section, optimized for particle charging, before each of the short collecting sections. Optimization is achieved by providing both a high current density and high electric field. The collecting sections are optimized to provide a very high average electric collecting field. By this means it was found that the majority of the freshly charged particles were collected in the first portion of the collecting section following the charging section. Uncollected particles are further charged, and reentrained particles are recharged and collected by the following charger and collector pair.

Accordingly, the present invention provides an electrostatic precipitator having a plurality of charging sections and a like number of collector sections alternating in series. Each collector section is formed of a plurality of parallel collection plates, the lengths of which define the length of the collector section. The parallel collection plates are evenly spaced apart to further define a plurality of gas flow lanes of width d therebetween. At least one, and preferably 2 or 3 aligned, first type corona discharge electrodes are provided in each gas flow lane. Where 2 or 3 corona electrodes are present in each gas flow lane, those electrodes are preferably spaced apart by a distance of about d. Each collector section is preceded by a charging section containing a plurality of second corona discharge electrodes arranged in a linear array transverse to the gas flow and therefore transverse to the planes in which the collection plates lie. In the preferred embodiments that linear array in each charging section has a plurality of grounded pipes alternating with the second corona discharge electrodes.

The length of the collector sections is much shorter than in the prior art ESPs, both in actual length and in relation to the length of the charging sections and to the interplate spacing d. For example, in the preferred embodiments the length of each collector section will be 1–4*d*, more preferably 2–3*d*, or in absolute terms, preferably 0.4 to 1.0 meter in length. The length of each charging section is preferably 0.8 to 1.6*d*.

DESCRIPTION OF THE PREFERRED EMBODIMENTS

Figure 1:
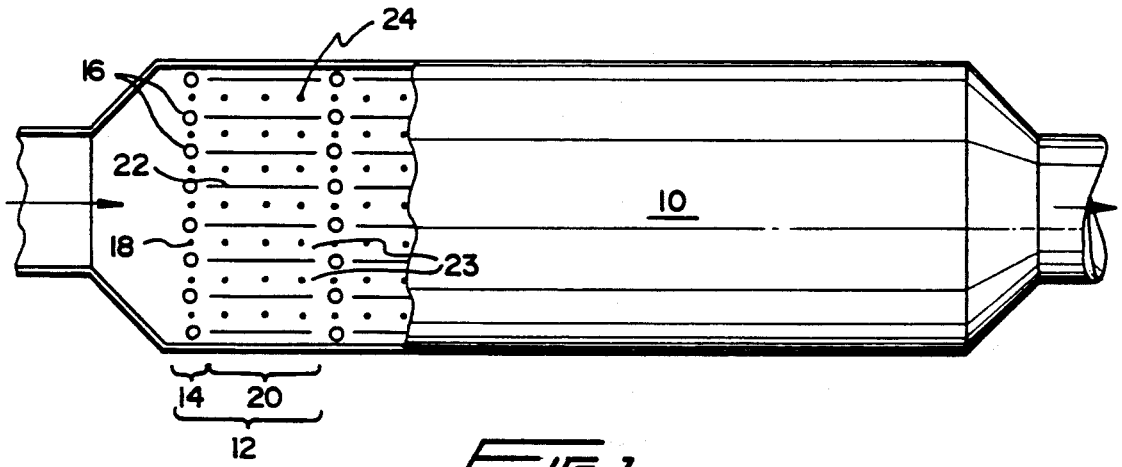
FIG. 1 is a schematic view, partially in cross-section, of a preferred embodiment of an ESP in accordance with the present invention.

A preferred embodiment of an ESP consisting of a multiplicity of modules 12 as shown in FIG. 1 and is generally designated by the numeral 10. The preferred embodiment for the module 12 includes a charging section 14 consisting of a planer array of grounded pipes 16, perpendicular to the gas flow, whose centers are the same distance apart as are the grounded collector electrode plates 22 of the short collector sections 20. The charging section 14 is located just upstream of its collection section 20. For high resistivity particle matter, cooling fluid is caused to flow through the grounded pipes 16 to lower the resistivity of any collected particle matter thereby preventing the occurrence of back corona. For low resistivity particle matter, which does not cause back corona, it is not necessary to provide cooling.

Each charging section 14 further includes a plurality of corona discharge electrodes 18. Each electrode 18 preferably has a diameter D of about 3 mm. These corona wires 18 alternate in series with the grounded pipes 16 in an array which is transverse to the gas flow. Grounded pipes 16 preferably have a diameter of at least 15 D and are preferably 50–80 mm in diameter.

Each of the collector sections 20 following a charging section 14 should be about 0.4 to 1.0 m in length. Each collector section 20 should contain one to three corona discharge electrodes 24 about 3–10 mm in diameter. The diameter of the discharge electrodes 24 is preferably as large as is possible, e.g. at least 2 D up to about 10 mm, to allow use of as high a voltage as is possible, while still allowing a modest corona current to flow. In general, the corona current increases with increasing voltage. The maximum voltage is limited by sparking for low resistivity particle matter, and by back corona for high resistivity particle matter.

The corona discharge electrodes for both the charging sections and collection sections are connected to DC power supplies, 25 and 26 respectively. The voltages applied to the electrodes may be either negative or positive. Regardless of which polarity is used, the polarity of both the charging and collection sections should be the same. The preferred embodiment is negative polarity, to allow the application of higher voltages than is possible with positive polarity. The use of higher voltages will consequently result in improved collection. An individual power supply for each section is the preferred embodiment to allow optimization of the setting of the voltages and currents.

The collection plates 22 are spaced by a distance d to define a plurality of gas flow lanes 23 therebetween.

Figure 2:
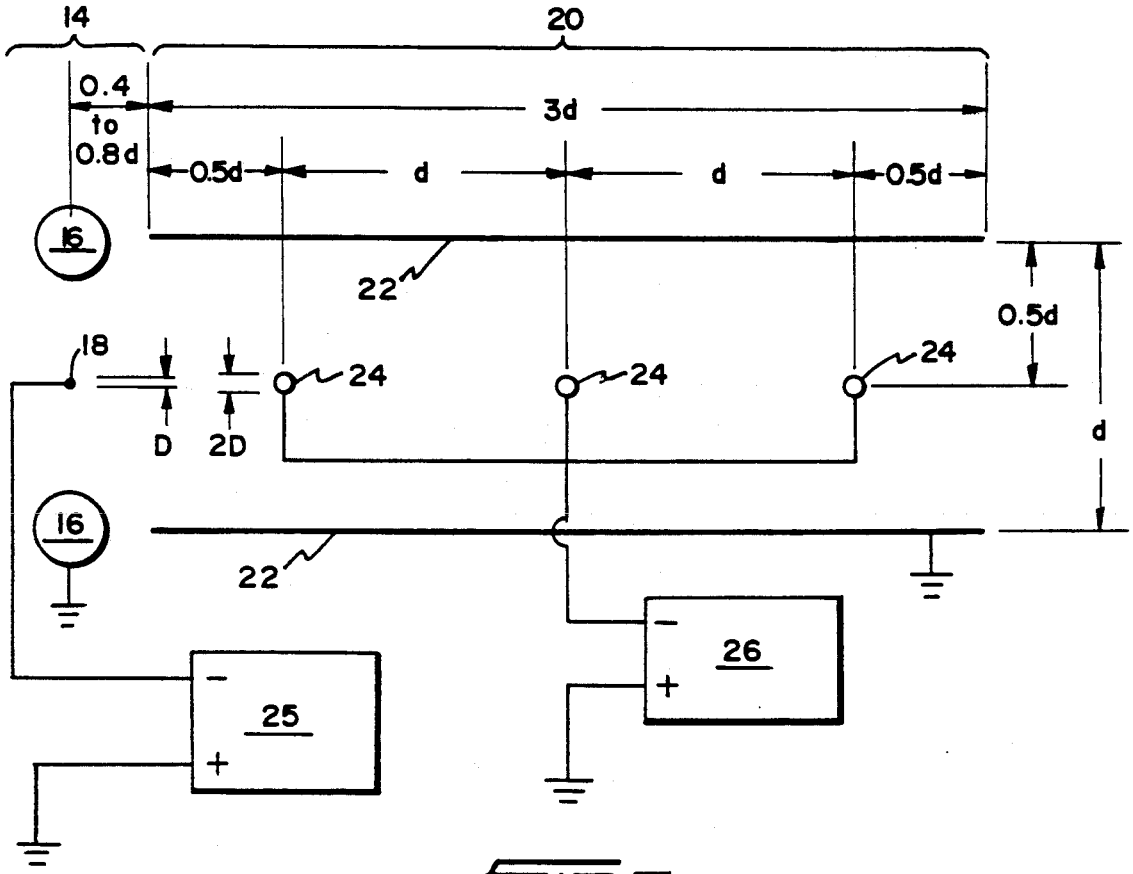
FIG. 2 is a schematic view of one charging section/-collector section module of the ESP in FIG. 1.

Relative dimensions for a module containing three corona discharge electrodes 24 per gas flow lane 23 is shown in FIG. 2. The basic dimension is the distance between the collector plates, d. Most of the other dimensions are given in terms of d.

The range of voltages and currents for the various electrodes are provided in Table 1 below. The voltages are given as the average electric field; the electric field is the applied voltage divided by the distance between the corona discharge electrode and the grounded electrode. The current is given in terms of a current density, which is current per unit of area of the grounded electrode. As the dimension d is increased the applied voltage from the power supply must also increase to maintain the same electric field. Interpretation and application of the design information and data can easily be done by workers in and practicers of the art of electrostatic precipitation.

TABLE 1

| | | |
|---|---|---|
| Charging Section | Electric field, kV/cm, | 6–8 |
| | Current density, nA/cm$^2$ | 200–1500[a] |
| Collector Section (Low resistivity) | Electric field, kV/cm, | 3.5–6 |
| | Current density, nA/cm$^2$ | 0–50[b] |
| Collector Section (High resistivity) | Electric field, kV/cm, | 3.5–6 |
| | Current density, nA/cm$^2$ | 0–5[b] |

Notes:
[a]The ability to cool the pipes and particle layer in the charging section makes current density generally independent of particle resistivity.
[b]Under certain operating conditions, i.e. high concentration of fine particles in gas stream which leads to a large space charge in the ESP, it may be difficult to have a current flow in some of the upstream collectors. As the particles collect, in advancing through the ESP, the space charge will decrease and current will flow.

The shape of the corona discharge electrodes for the charger section should be chosen to provide both a high current density and a high electric field. For the collection sections the corona discharge electrodes should be chosen to provide a high electric field and a low current density. The preferred embodiment for the corona discharge electrodes are round electrodes of the correct diameters. As the diameter of the round electrode is increased the voltage required for a desired current also increases. Round electrodes of the correct diameter will provide the desired electrical conditions with minimum problems. However for mechanical and other design reasons corona discharge electrodes of other shapes than round wires are often used in ESPs. Workers in the ESP art are familiar with various electrode shapes and the electrical conditions that result from their use. Corona discharge electrodes of other shapes may be used provided that they produce the desired electrical conditions.

Figure 3:
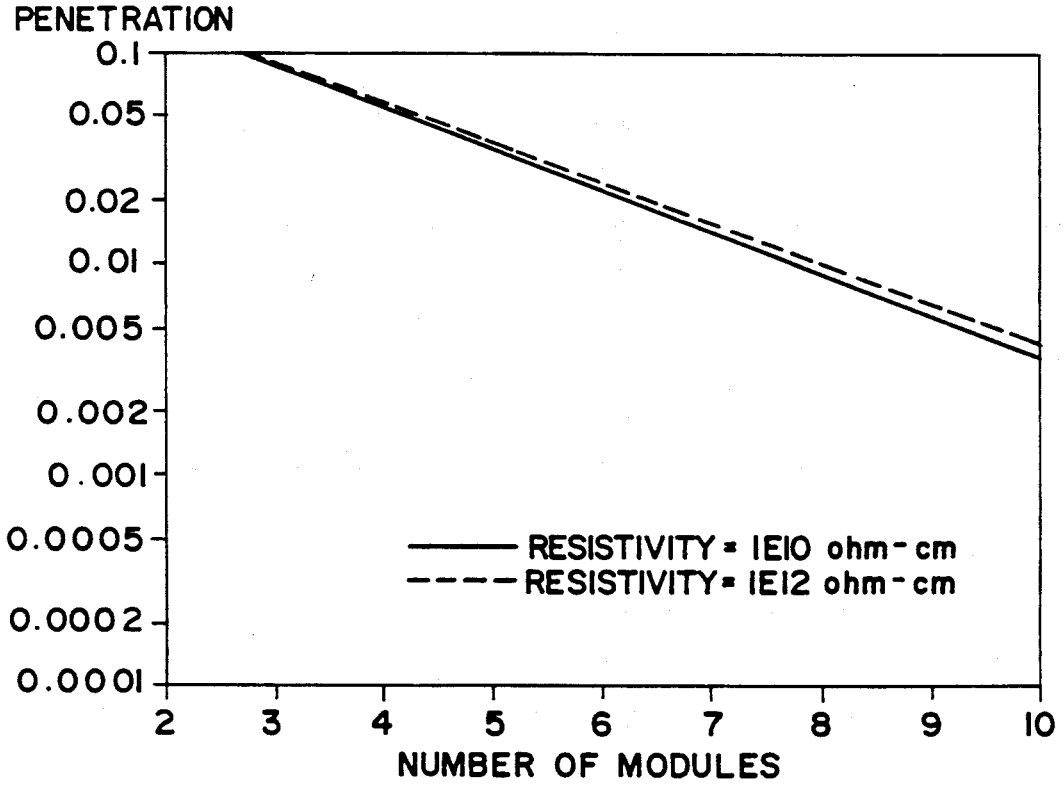
FIG. 3 is a graph of penetration versus number of modules in accordance with the present invention wherein each gas lane of each collector section has only one collector corona discharge electrode.
Figure 4:
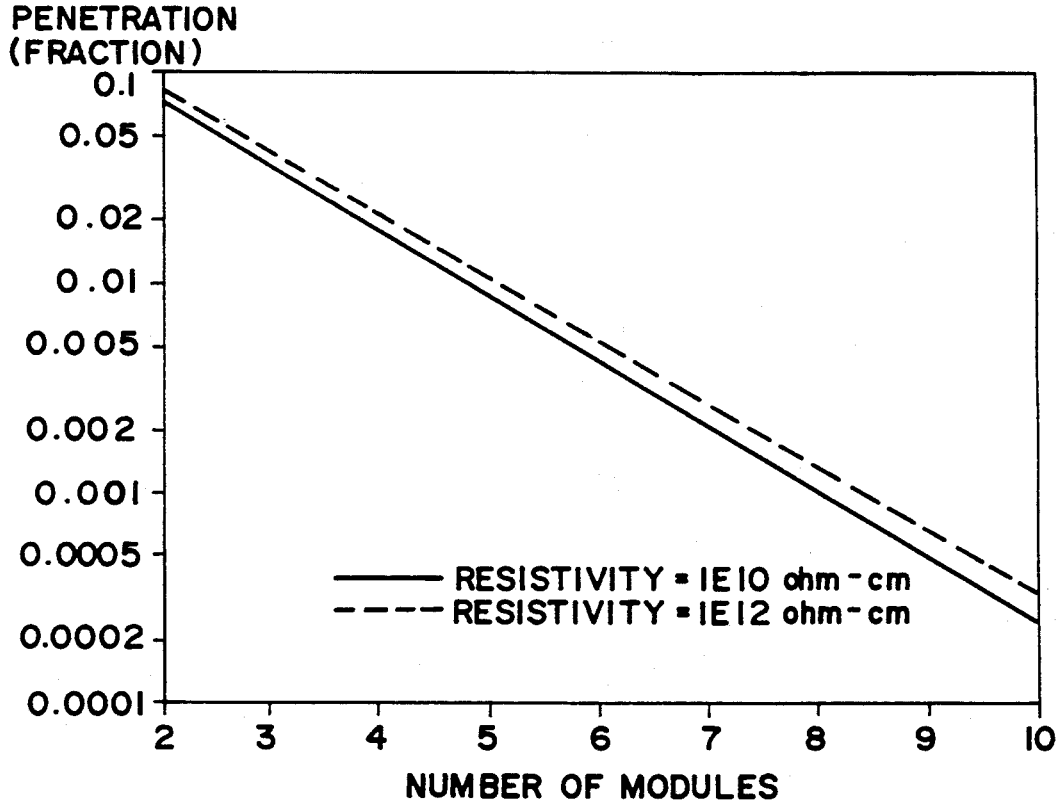
FIG. 4 is a graph of penetration versus number of modules wherein each gas lane of each collector section has two corona discharge electrodes.
Figure 5:
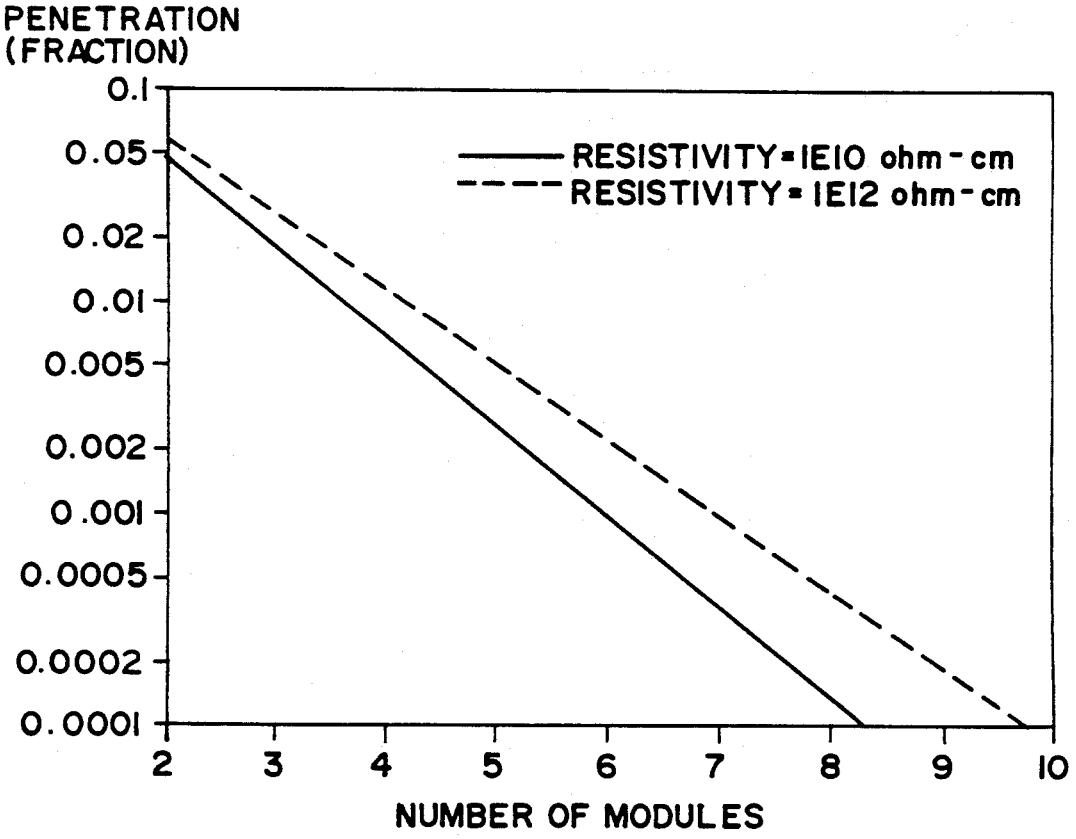
FIG. 5 is a graph for penetration versus number of modules in accordance with the embodiment of FIG. 2, in which each collector section has three corona discharge electrodes.
Figure 6:
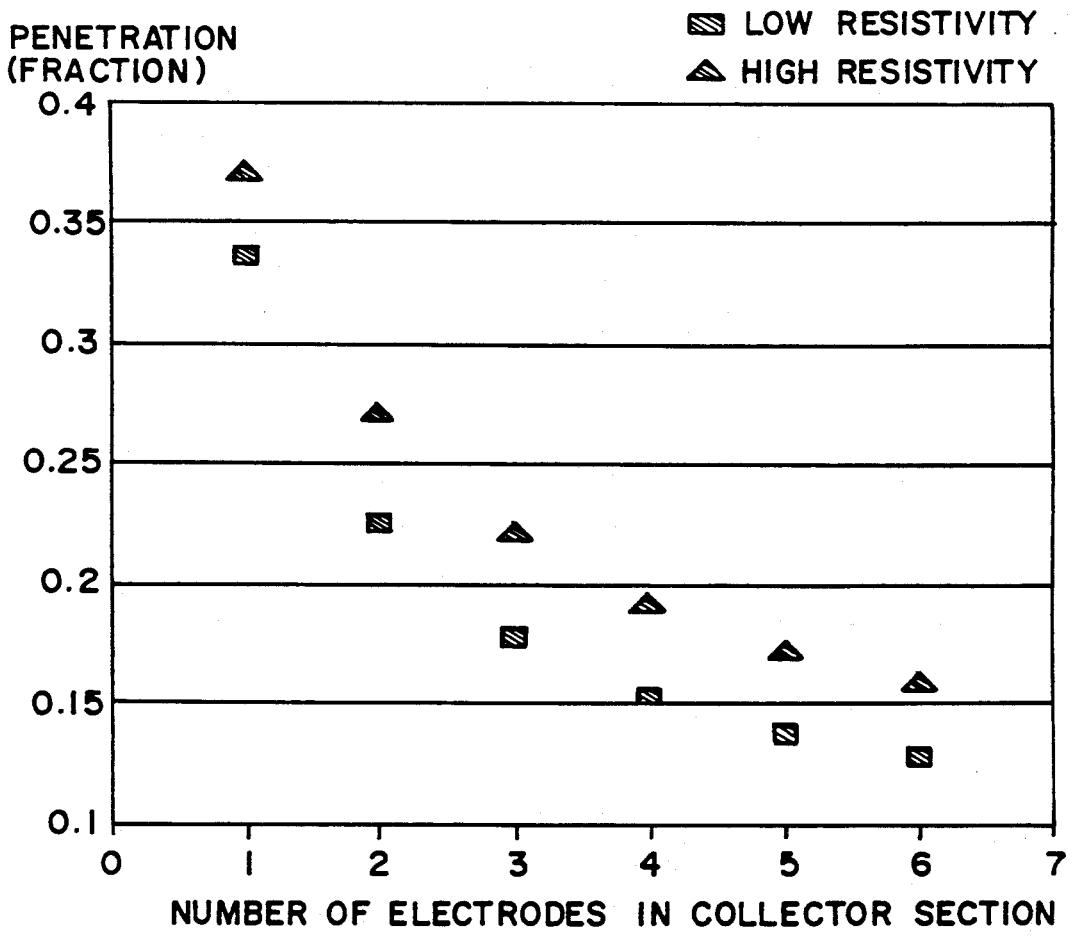
FIG. 6 is a graph of particle penetration for a single module as a function of the number of electrodes in the collector section.

Performance is shown in FIGS. 3 to 5 for the number of modules 12 vs. penetration. Penetration or the amount of particle matter that is not collected is equal to $1-E_{ff}$. The performance data is further broken down in respect to high and low resistivity and in the number of corona discharge electrodes, two or three, per collector section.

The penetration achieved by our ESP with alternating charging and short collector sections having 5 to 6 modules will meet or exceed the EPA New Source Performance Standard for particulate matter. Our improved ESP is one-quarter to one-tenth the size of a conventional ESP, depending upon particle resistivity and other particle conditions. The comparison of physical size between conventional ESPs and our ESPs with alternating charging and short collector sections is shown in Table 2, for collection of both low and high resistivity particulate matter.

TABLE 2

| ESP Type | Conventional | | Improved | |
|---|---|---|---|---|
| Particle resistivity | Low | High | Low | High |
| Sections[a] | 4 | 6 | 5 | 6 |
| Electrical Length[b] | 33 (10.1) | 81 (26.8) | 12.2 (14.6) | 14.6 (4.4) |
| Specific Collector area[c], ft$^2$/1000 ft$^3$/min (sec/m) | 248 (49) | 609 (121) | 92 (18) | 110 (22) |

TABLE 2-continued

| ESP Type | Conventional | | Improved | |
|---|---|---|---|---|
| Efficiency, % | 99.65 | 99.62 | 99.67 | 99.60 |

Notes:
The comparison is based upon controlling the particulate emissions of a typical coal fired utility boiler of 125 MW with a gas flow rate of 400,000 ft$^3$/min (11,330 m$^3$/min) at 300° F. (149° C.), a mass loading of 3 gr/ft$^3$ (6.7 g/m$^3$), and a particle size distribution which is defined by a geometric mass mean diameter of $15 \times 10^{-6}$ m (15 um) and a standard deviation of 3. Applying the analysis to other situations can be readily done by one accomplished in the ESP art.
[a]For conventional ESPs a section is the usual long collecting field. For ESPs with alternating charging and short collection sections, a section is defined as a module consisting of a charger/collector pair.
[b]The electrical length is the length of all of the sections if laid end-to-end without the usual spacing that is left between them. The actual length of an ESP, which will depend upon specific design and fabrication requirements, will be slightly longer than the electrical length.
[c]The specific collector area, used by workers in the ESP art as one of the means for defining the size of an ESP, is the ratio of the collection plate area to the gas flow.

Our smaller sized ESP with alternating charging and short collector sections offers the additional advantage of significantly reduced power requirement as compared to conventional electrostatic precipitation. The reduced power requirement is directly related to reduced collector electrode area. Assuming similar corona current densities, reduced area will require less current, and consequently less power.

This invention provides several advantages over the present art. These are:

It becomes possible to design and build an ESP significantly physically smaller than one that is designed and built according to the present state of the art while still achieving the same collection efficiency.

By building an ESP that is physically smaller than one built according to the current art, it is possible to build it for less cost, while achieving the same control efficiency.

The small physical size of the ESP with a corresponding reduction in collection electrode area means that the ESP consumes significantly less power for the same control efficiency.

The invention can be used for new installations or can be retrofitted to existing units. In either type of application it is possible to obtain a collection efficiency that is greater than the efficiency achievable by the current art for ESPs of the same size.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. An electrostatic precipitate comprising, in series:

a plurality of collector sections comprising:

a plurality of parallel collection plates, said collection plates being evenly spaced by a distance d to define the plurality of gas flow lanes therebetween, said collection plates defining the length of said collector section as 1–4*d*; and a least one first corona discharge electrode within each of said gas flow lanes; and a plurality of charging sections alternating in series with said collector sections, each collector section being immediately preceded by a charging section, each of said charging sections comprising a plurality of second corona discharge electrodes arranged in an array transverse to said gas flow lanes.

2. An electrostatic precipitator in accordance with claim 1 wherein each of said second corona discharge electrodes is spaced 0.9–1.3*d* from the nearest adjacent first corona discharge electrode.

3. An electroprecipitator in accordance with claim 1 wherein each collector section is 0.4 to 1.0 meter in length.

4. An electroprecipitator in accordance with claim 1 containing at least five collector sections.

5. An electroprecipitator in accordance with claim 1 wherein the diameter of each of said second corona discharge electrodes is D and the diameter of each of said first corona discharge electrodes is at least 2D.

6. An electroprecipitator in accordance with claim 1 comprising a plurality of modules in series, each of said modules consisting of one of said collector sections and one of said charging sections.

7. An electrostatic precipitator in accordance with claim 1 wherein each of said first and second corona discharge electrodes is centered with respect to one of said gas flow lanes, whereby each of said second corona discharge electrodes is aligned with the one or more first corona discharge electrodes within the gas flow lane upon which it is centered.

8. An electrostatic precipitator in accordance with claim 7 wherein each linear array further includes a plurality of anode pipes alternating with said second corona discharge electrodes, each of said grounded pipes being aligned with one of said collection plates.

9. An electrostatic precipitator in accordance with claim 8 wherein the length of each of said charging sections is 0.8–1.6*d* with said anodes being spaced 0.4–0.8*d* from the edges of the collection plates of an adjacent collector section.

10. An electroprecipitator in accordance with claim 8 wherein the diameter of each of said second corona discharge electrodes has a diameter D, the diameter of each of said first corona discharge electrodes is at least 2D and the diameter of each of said grounded pipes is at least 15D.

11. An electrostatic precipitator in accordance with claim 1 wherein each of said gas flow lanes has two or three first corona discharge electrodes contained therein and spaced apart by a distance of approximately d, the length of each collector section being about 2*d* for two first corona discharge electrodes and 3*d* for three first corona discharge electrodes.

12. An electrostatic precipitator in accordance with claim 11 wherein each of said second corona discharge electrodes is spaced 0.9–1.3*d* from the nearest adjacent first corona discharge electrode.

* * * * *